US011363843B1

(12) United States Patent
Ernst et al.

(10) Patent No.: US 11,363,843 B1
(45) Date of Patent: Jun. 21, 2022

(54) SAFETY VEST WITH LIGHT TUBES

(71) Applicant: Coast Cutlery Co., Portland, OR (US)

(72) Inventors: Todd Ernst, Portland, OR (US); Brian Sheehy, Los Angeles, CA (US)

(73) Assignee: Coast Cutlery Co., Portland, OR (US)

( * ) Notice: Subject to any disclaimer, the term of this patent is extended or adjusted under 35 U.S.C. 154(b) by 0 days.

(21) Appl. No.: 17/207,602

(22) Filed: Mar. 19, 2021

(51) Int. Cl.
*A41D 13/01* (2006.01)
*A41D 31/32* (2019.01)
*F21V 33/00* (2006.01)

(52) U.S. Cl.
CPC ..... *A41D 13/01* (2013.01); *A41D 31/32* (2019.02); *F21V 33/0008* (2013.01)

(58) Field of Classification Search
CPC ..... A41D 13/01; A41D 31/32; F21V 33/0008
See application file for complete search history.

(56) References Cited

U.S. PATENT DOCUMENTS 5,879,076 A * 3/1999 Cross ..... G08B 5/004 362/555

OTHER PUBLICATIONS

Global Glove; FrogWear HV Premium Surveyors LED Vest—GLO-12LED; Accessed on Mar. 16, 2021 from https://www.globalglove.com/frogwear-hv-lightweight-mesh-safety-led-vest-glo-12led; 2 pages.
Global Glove; FrogWear HV Premium Surveyors LED Vest—GLO-15LED; Accessed on Mar. 16, 2021 from https://www.globalglove.com/frogwear-hv-premium-surveyors-led-safety-vest-glo-15led; 2 pages.
Nite Beams; Hi Vis LED Safety Vest—Class 2—Public Safety; Accessed on Mar. 16, 2021 from https://www.nitebeams.com/product/hi-vis-yellow-5-pt-breakaway-class-2; 2 pages.
Portwest; Portwest Orion LED Executive Vest—L476; Accessed on Mar. 16, 2021 from https://www.cabletiesandmore.com/led-executive-safety-vest-orion?bid=19704&gclid=Cj0KCQiAv6yCBhCLARIsABqJTjbyV7UOb1FKfDxdvPbKNFpSPrJ3nGe-SVVWOZbp7TXZZ6W0ppWgEKgaAIJkEALw_wcB; 2 pages.
Superior Led; Illuminated LED Safety Vest With NO ID Panel; Accessed on Mar. 16, 2021 from https://www.buysuperiorled.com/vestnoid.html; 2 pages.
Uline; LED Hi-Vis Safety Vest; Accessed on Mar. 16, 2021 from https://www.uline.com/BL_1143/LED-Safety-Vest; 1 pages.
Uvex; Uvex Protection Active Flash; Accessed on Mar. 16, 2021 from https://www.uvex-safety.com/en/product-group/uvex-protection-active-flash-safety-through-active-lighting/; 3 pages.

* cited by examiner

*Primary Examiner* — Thomas M Sember
(74) *Attorney, Agent, or Firm* — Schwabe Williamson & Wyatt, P.C.

(57) ABSTRACT

A safety vest includes a vest body including front, back and sides, a light source having a battery pack and at least one LED, the light source being removably mounted to the vest body, at least one light tube extending from one side of the light source, for receiving light projected from the LED and conveying the light along the length of the light tube, the light tube extending along the front, back or sides of the vest, and vest fabric mounted over the light tube to hold it in position against the vest body, the vest fabric being at least translucent and therefore permitting light from the light tube to shine therethrough.

17 Claims, 19 Drawing Sheets

SAFETY VEST WITH LIGHT TUBES

TECHNICAL FIELD

The present disclosure relates generally to the field of safety vests.

BACKGROUND

Safety vests have been used for many years. They typically are fabricated from reflective material or have reflective sashes or bands so that drivers coming upon workers will see the reflecting vest and avoid a collision. Construction workers, joggers, walkers, bicycle riders and others traveling, working on, or close to roads where vehicles will be driving also often wear such vests. Reflective vests are often effective in warning drivers about the presence of workers. However, even with reflective material prominently placed on safety vests, they may not make the person wearing the vest as visible as if it was daytime. Moreover, vests often get dirty, which can reduce the reflective capability of the vests. Also, in certain settings vests might be used where the party coming upon the worker might not have a light to render the reflective material visible. For example, runners, bicycle riders or even walkers coming up on someone in a reflective vest might not be using a light to shine on the reflective material. Therefore, the safety vest might be ineffective to avoid a collision.

One approach to overcome these issues has been to provide LED buttons that provide an active light source and thus alert the driver or person coming up on someone having such a vest that someone is in their travel path. While such buttons or the like may provide some assistance, they have not proven much more effective than a vest bearing prominent reflective material.

BRIEF DESCRIPTION OF THE DRAWINGS

Embodiments will be readily understood by the following detailed description in conjunction with the accompanying drawings and the appended claims. Embodiments are illustrated by way of example and not by way of limitation in the figures of the accompanying drawings.

DETAILED DESCRIPTION

Figure 1:
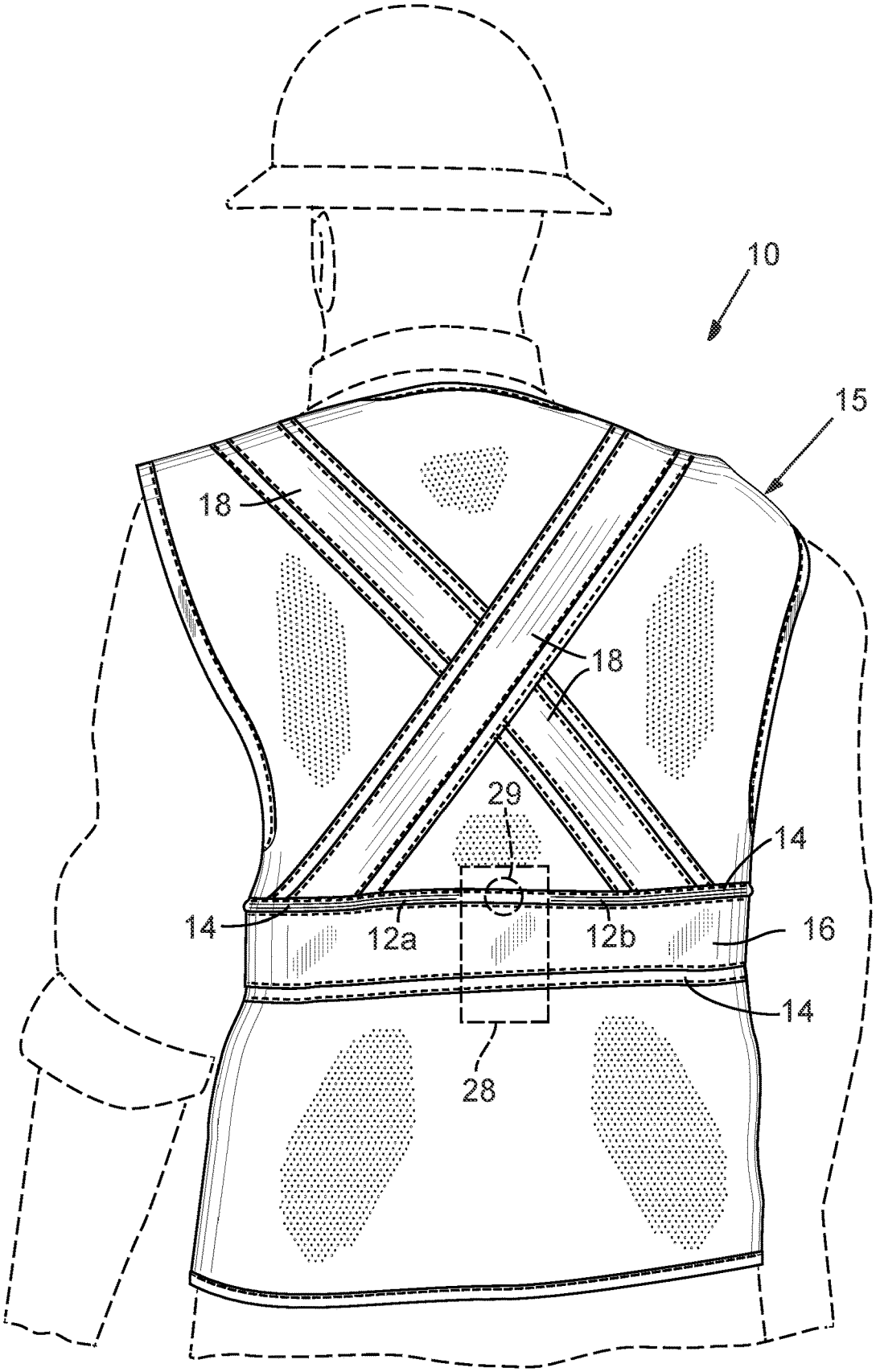
FIG. 1 is a perspective view of the back of a person wearing a first embodiment of the disclosure, showing a first pair of light tubes disposed in the vest.
Figure 2:
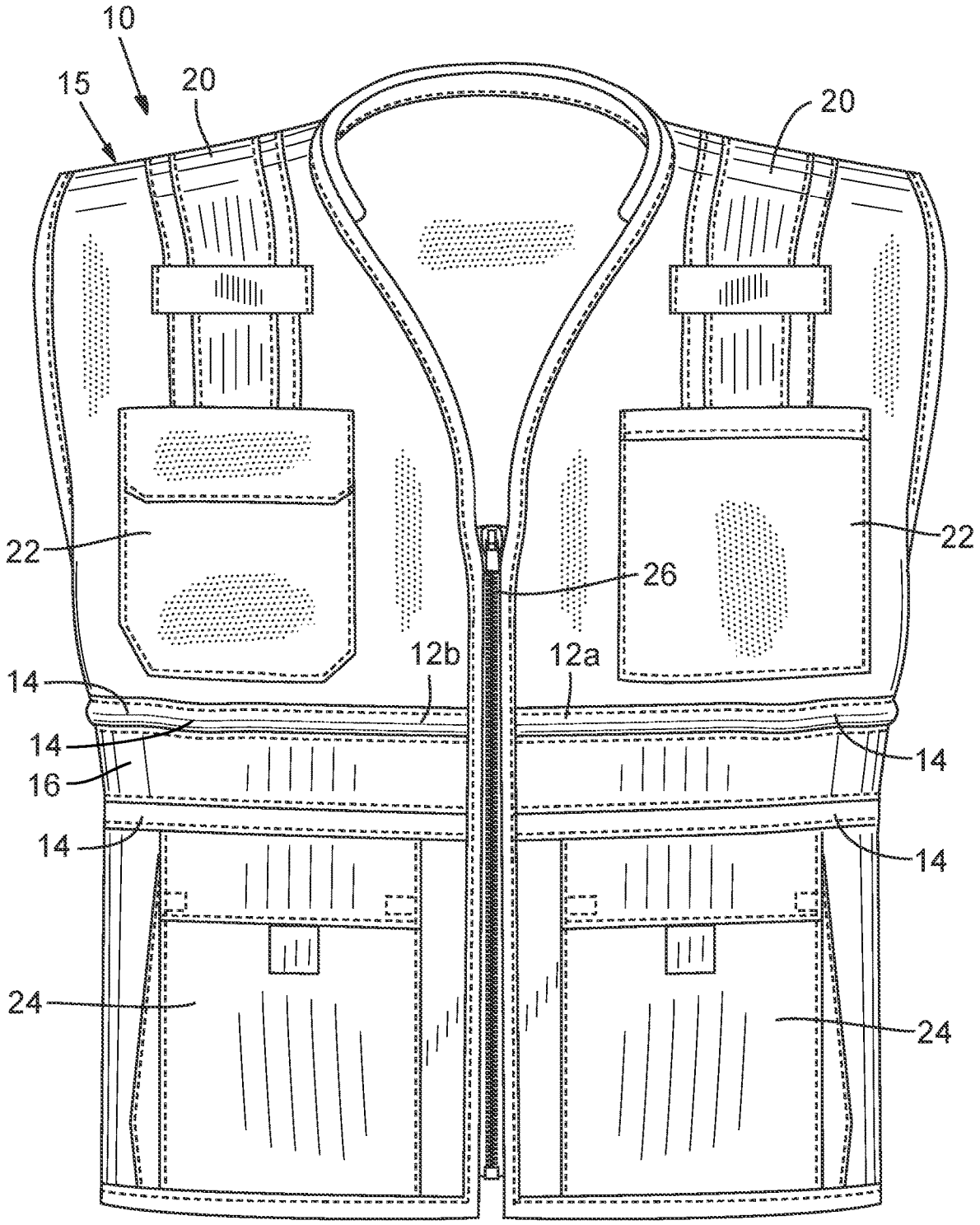
FIG. 2 is a front elevation view of the first embodiment.
Figure 3:
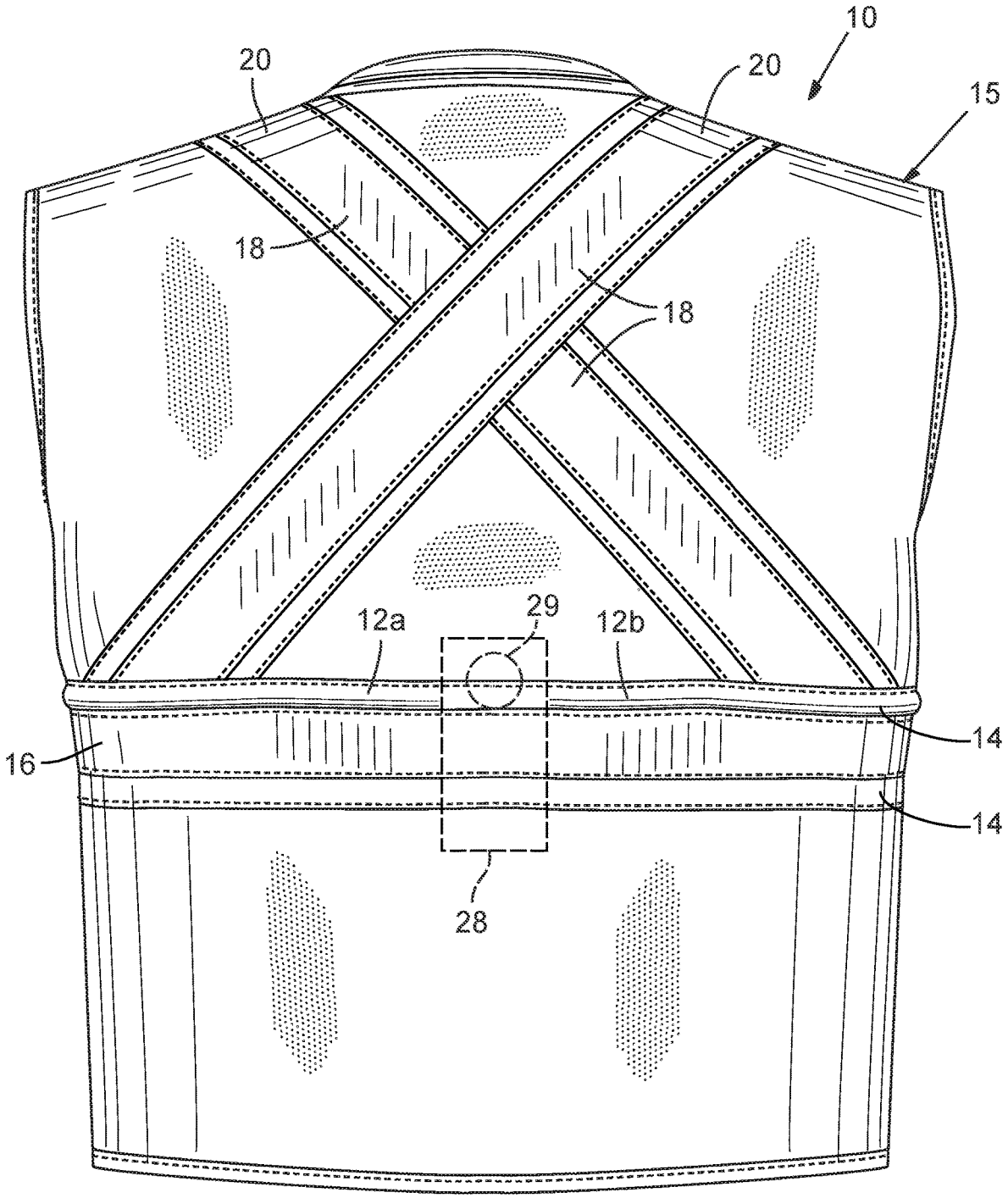
FIG. 3 is a rear elevation view of the first embodiment.
Figure 4:
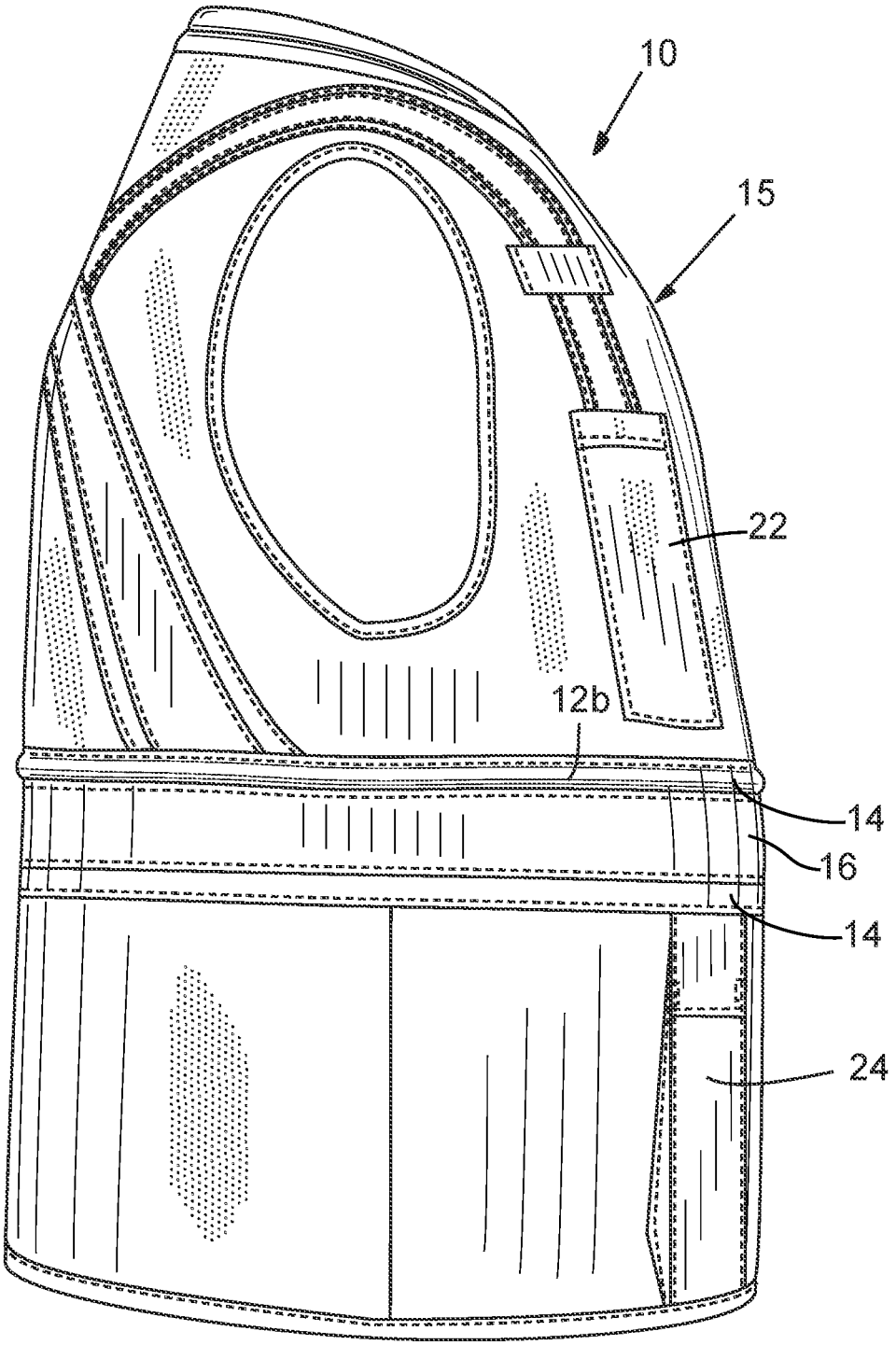
FIG. 4 is a side elevation view of the first embodiment from the right side.
Figure 5:
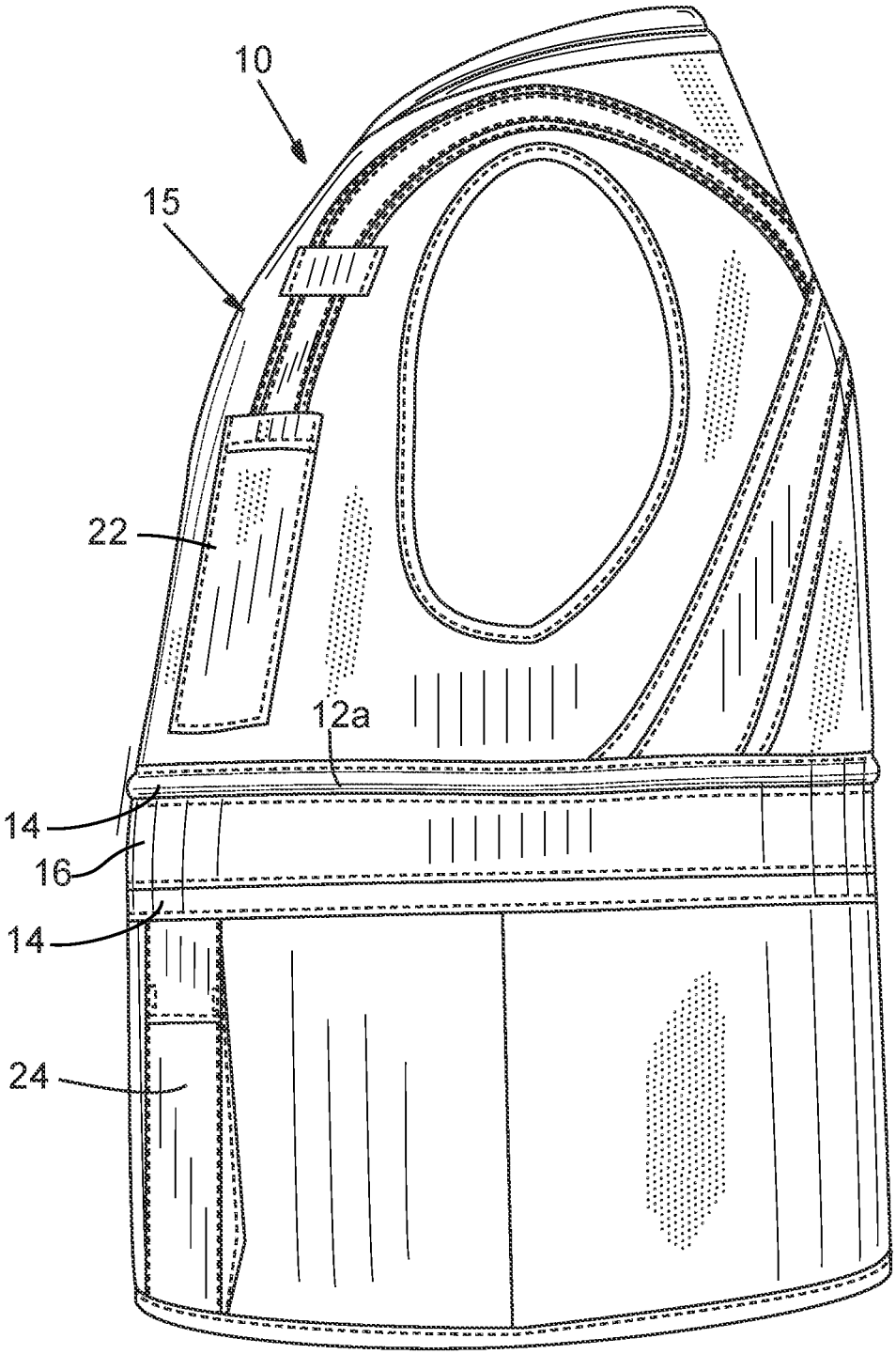
FIG. 5 is a side elevation view of the first embodiment from the left side.
Figure 6:
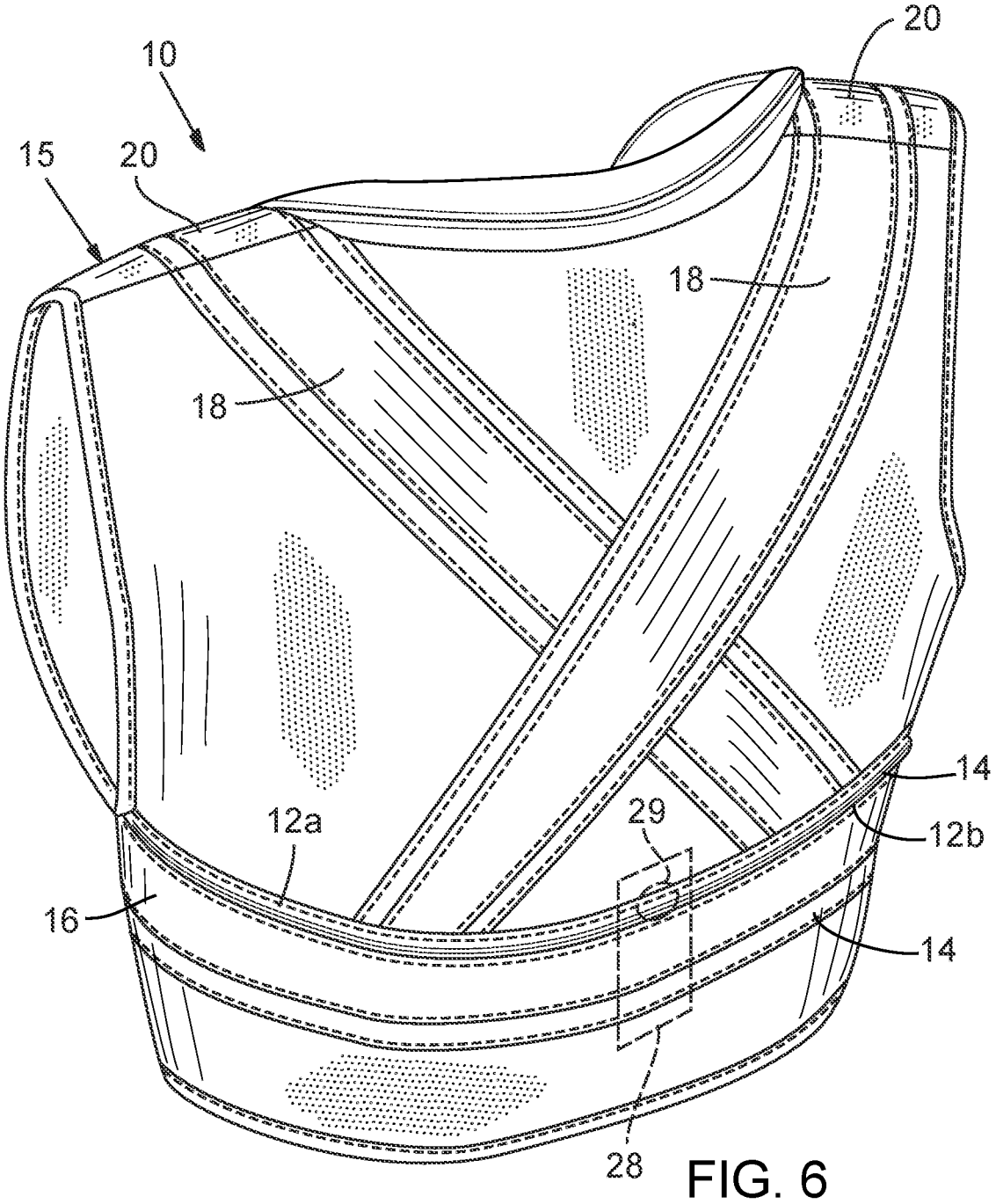
FIG. 6 is a perspective view of the first embodiment from an upper, rear angle.
Figure 7:
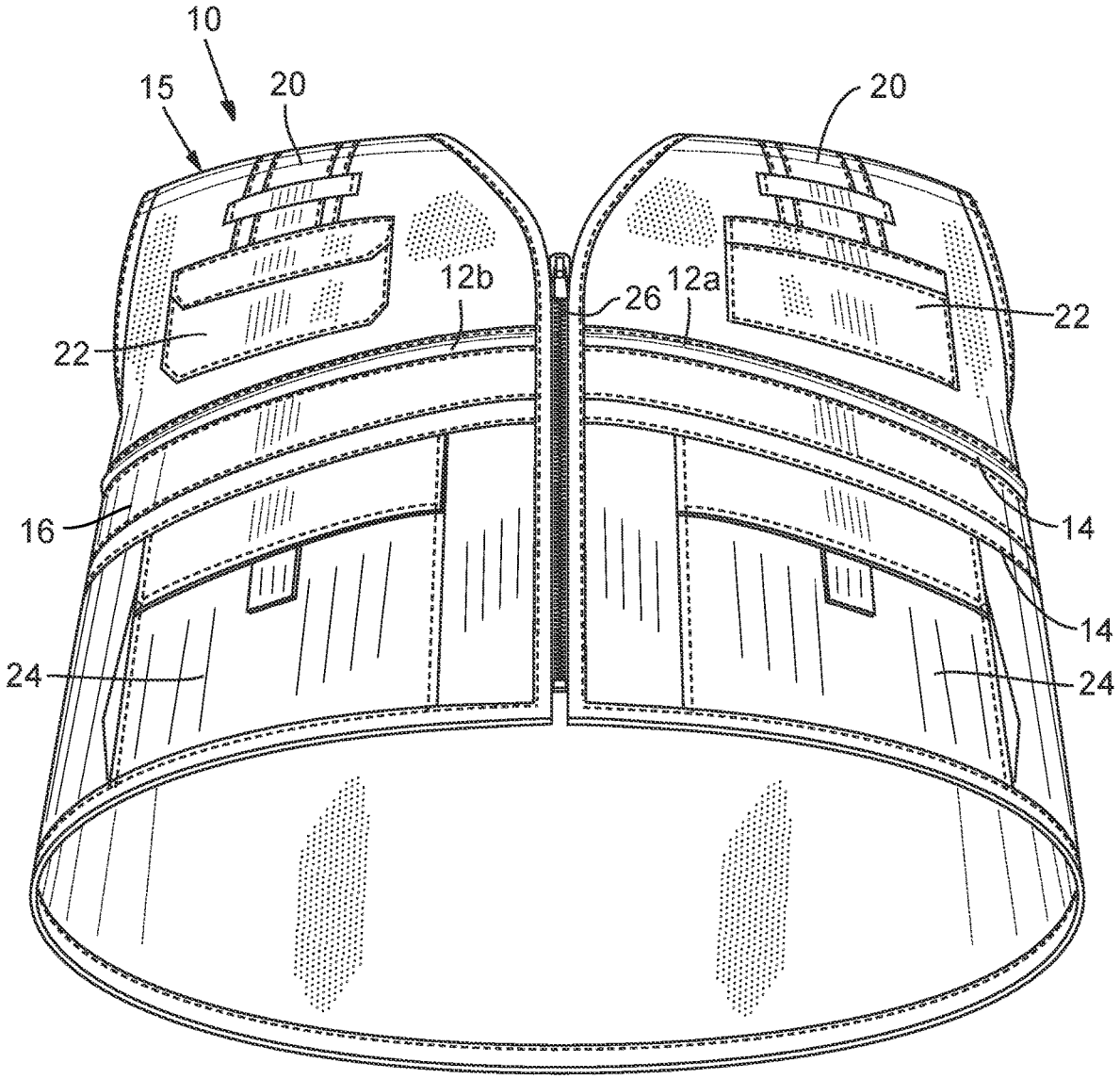
FIG. 7 is a perspective view of the first embodiment from a front, lower angle.
Figure 8:
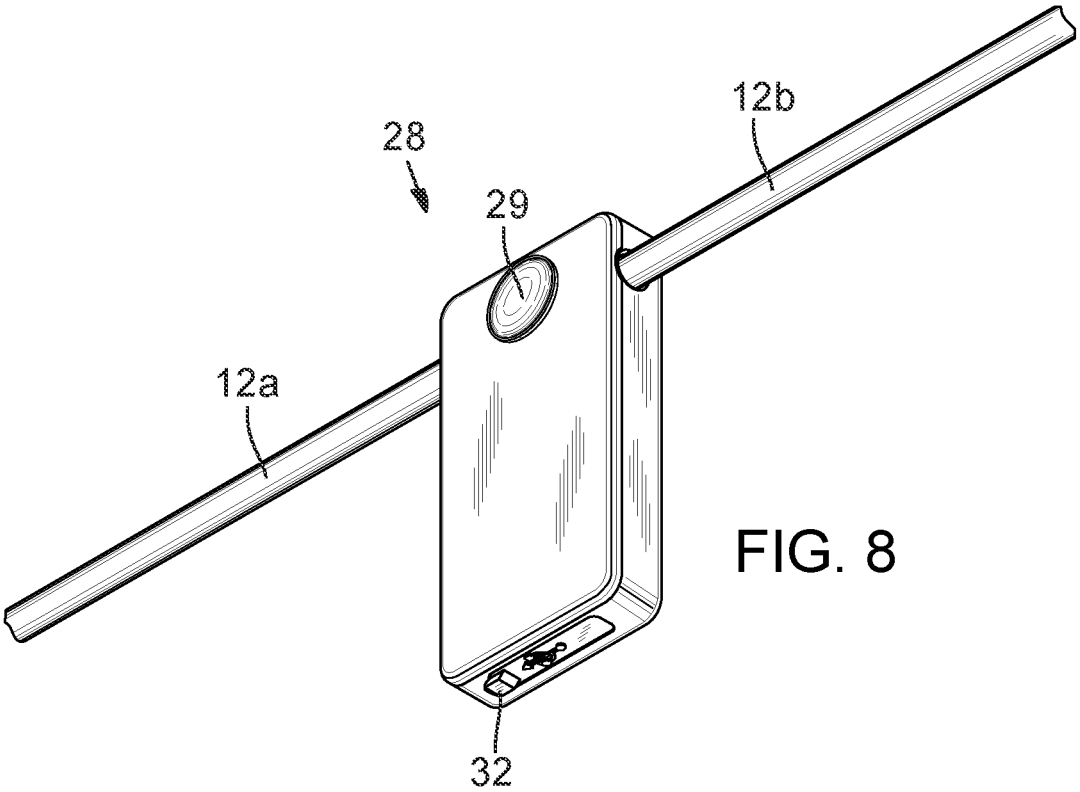
FIG. 8 is a perspective view of the light source of the first embodiment, also showing the first pair of tubes extending therefrom.
Figure 9:
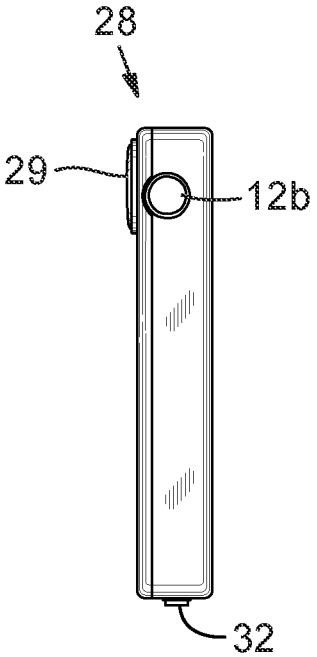
FIG. 9 is a side elevation view of the light source and tubes of the first embodiment taken from the left side.
Figure 10:
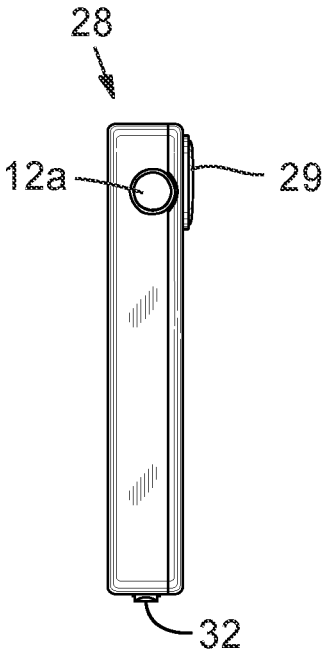
FIG. 10 is a side elevation view of the light source and tubes of the first embodiment taken from the right side.
Figure 11:
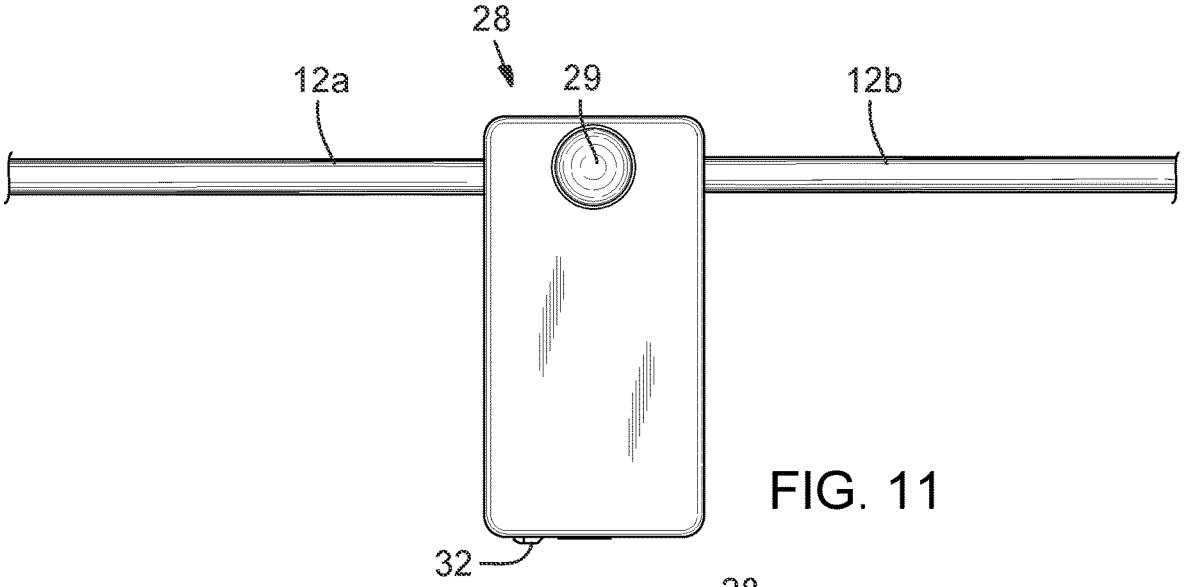
FIG. 11 is a front elevation view of the light source and tubes of the first embodiment.
Figure 12:
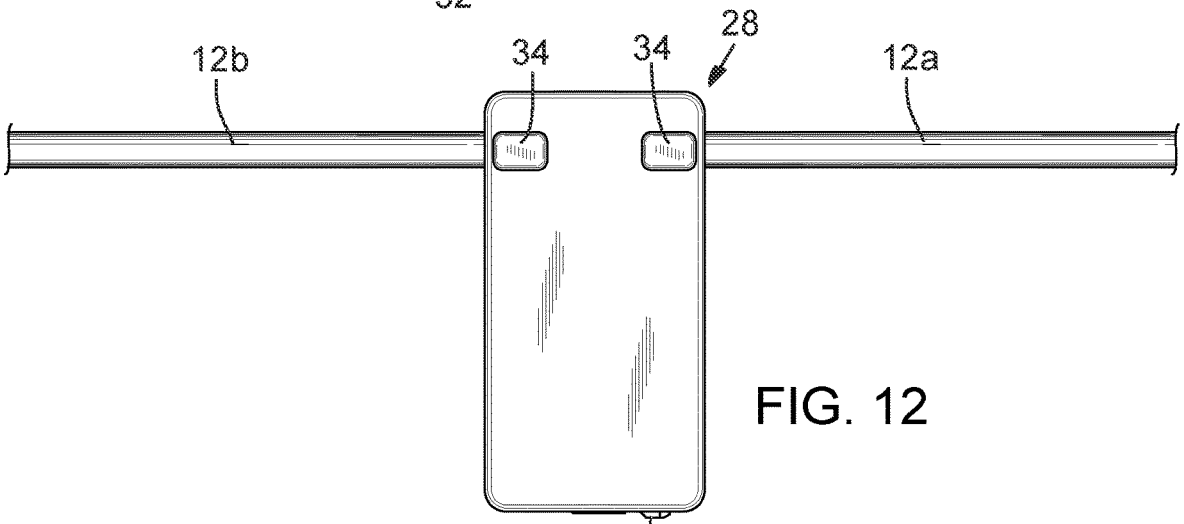
FIG. 12 is a rear elevation view of the light source and tubes of the first embodiment.
Figure 13:
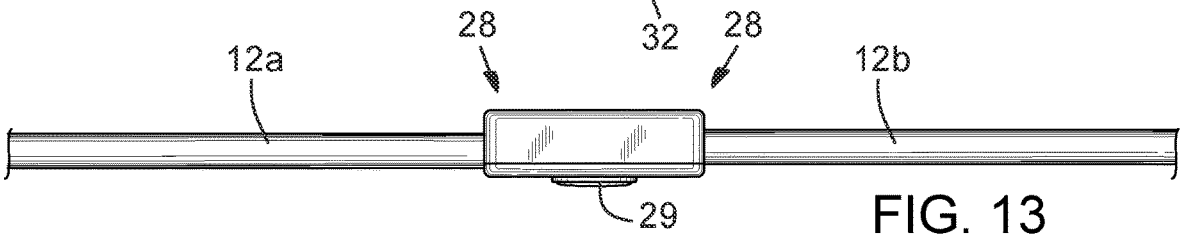
FIG. 13 is a top plan view of the light source and tube of the first embodiment s.
Figure 14:
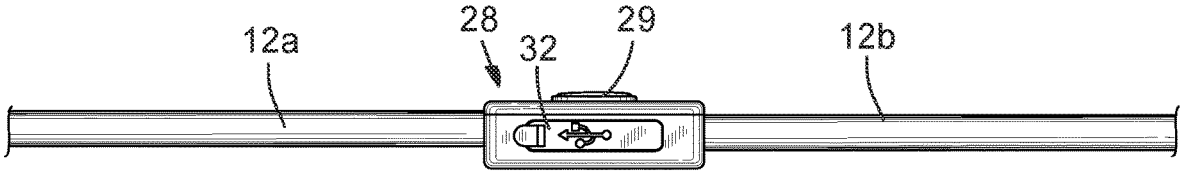
FIG. 14 is a bottom view of the light source and tubes of the first embodiment.
Figure 15:
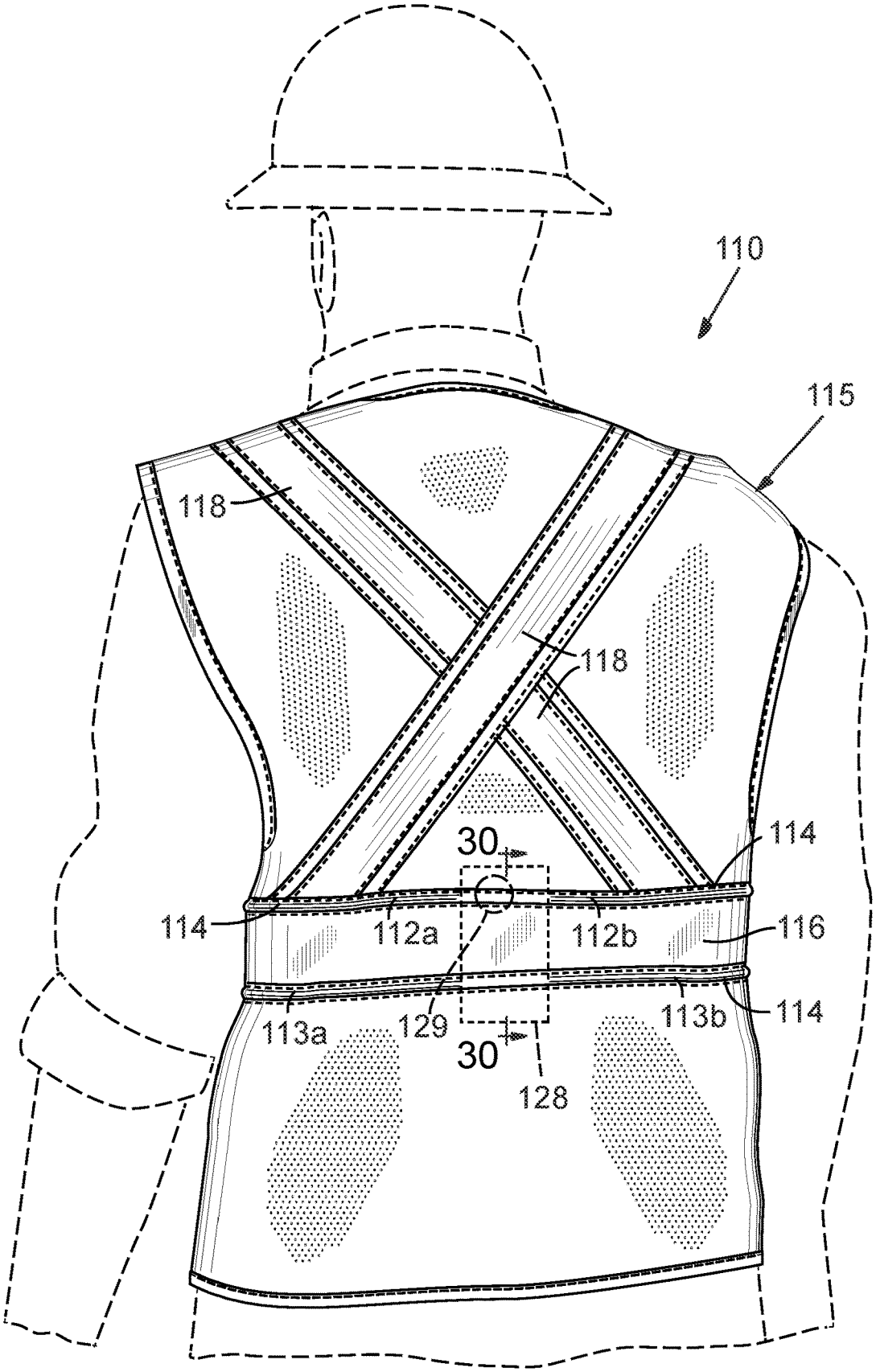
FIG. 15 is a perspective view of the back of a person wearing a second embodiment of the disclosure, showing first and second pairs of light tubes disposed in the vest.
Figure 16:
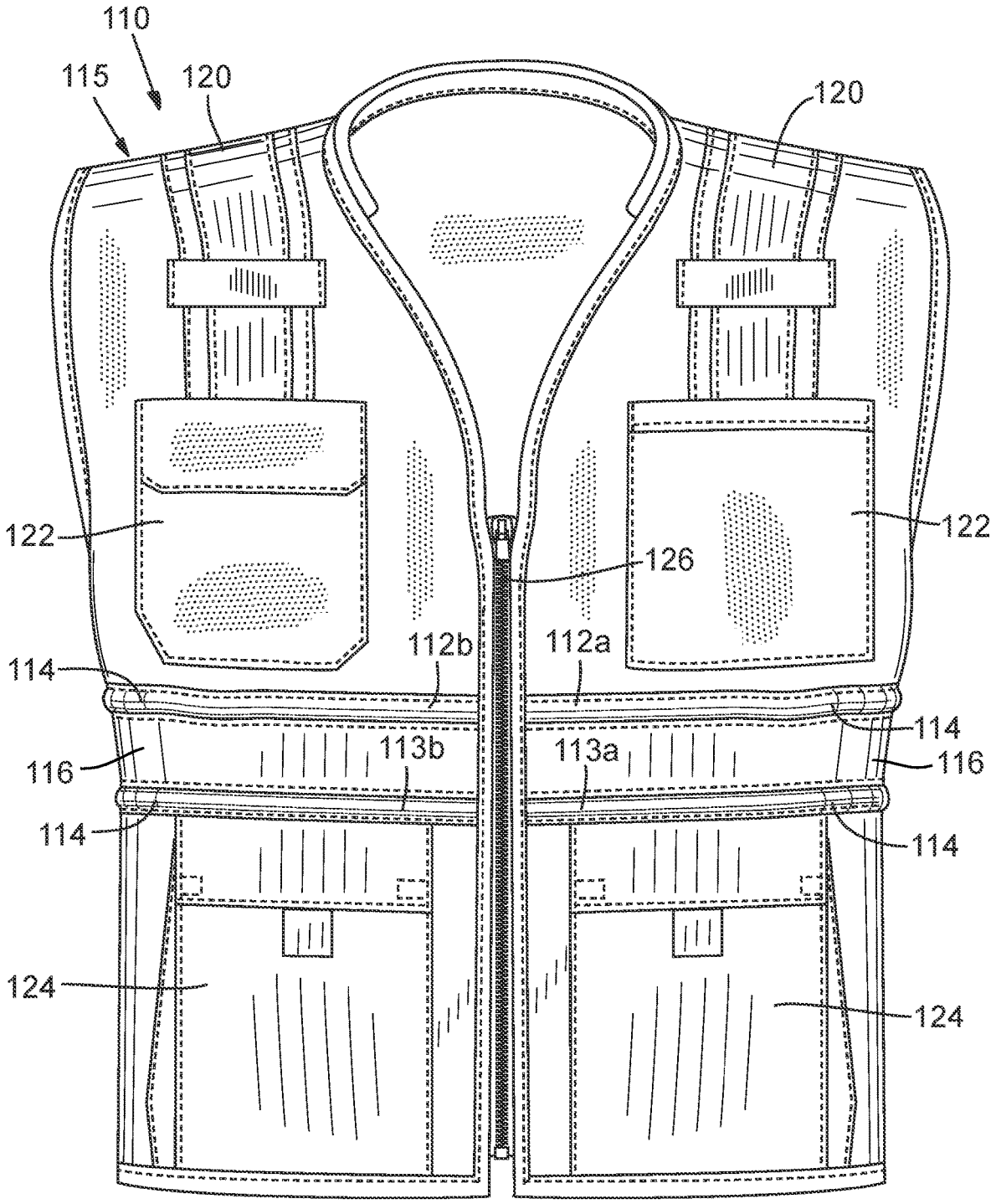
FIG. 16 is a front elevation view of the second embodiment.
Figure 17:
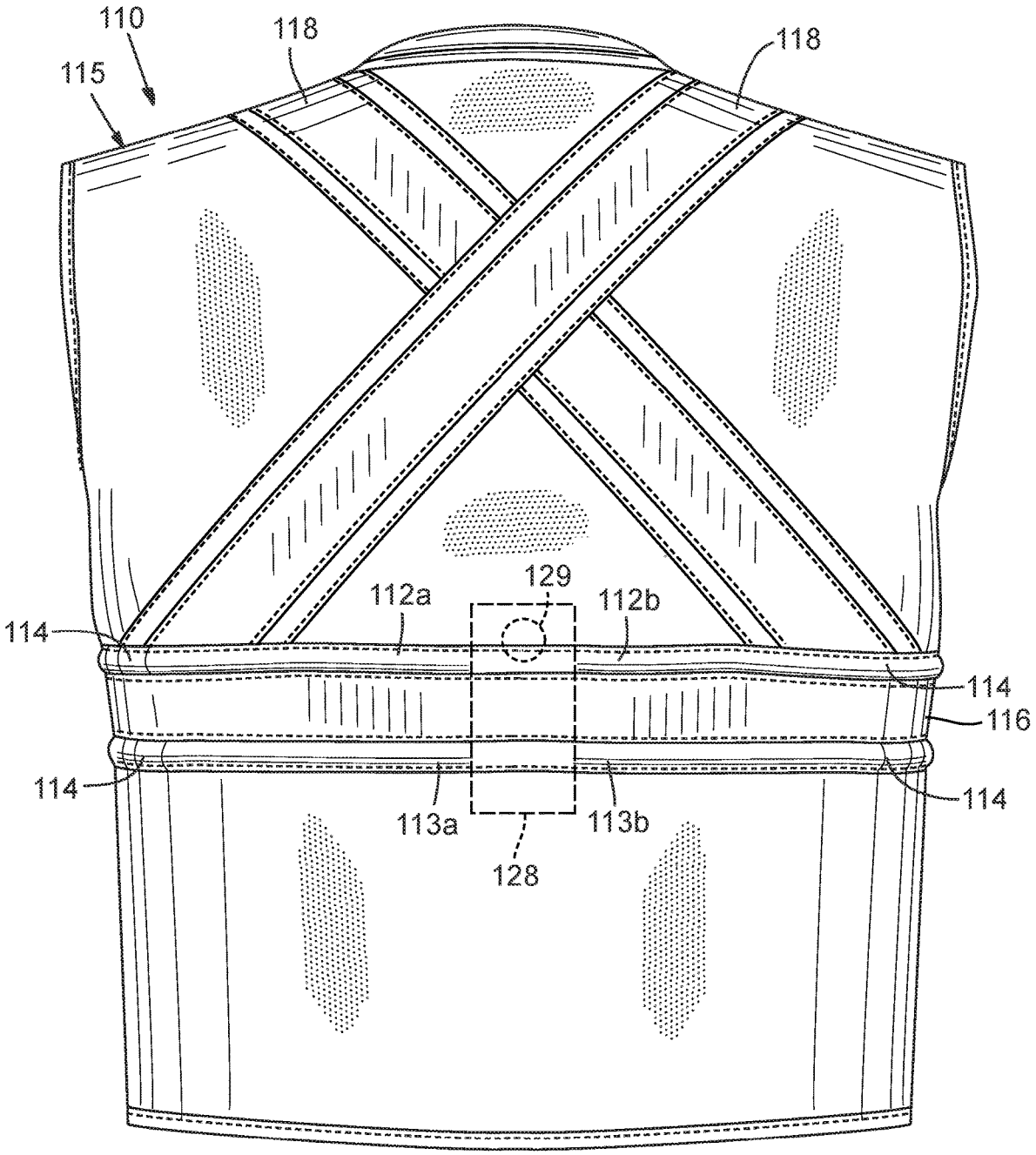
FIG. 17 is a rear elevation view of the second embodiment.
Figure 18:
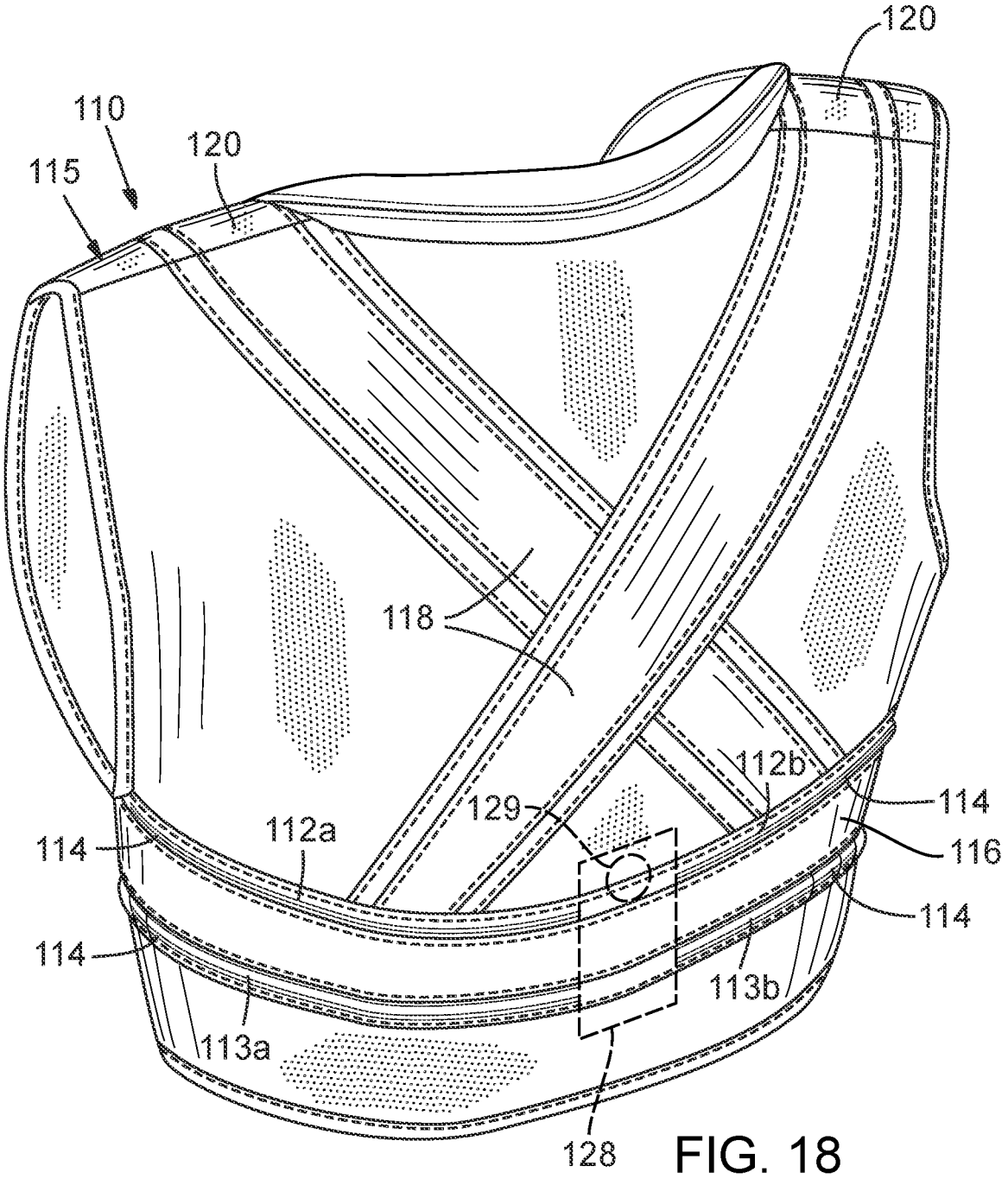
FIG. 18 is a perspective view of the second embodiment from an upper rear angle.
Figure 19:
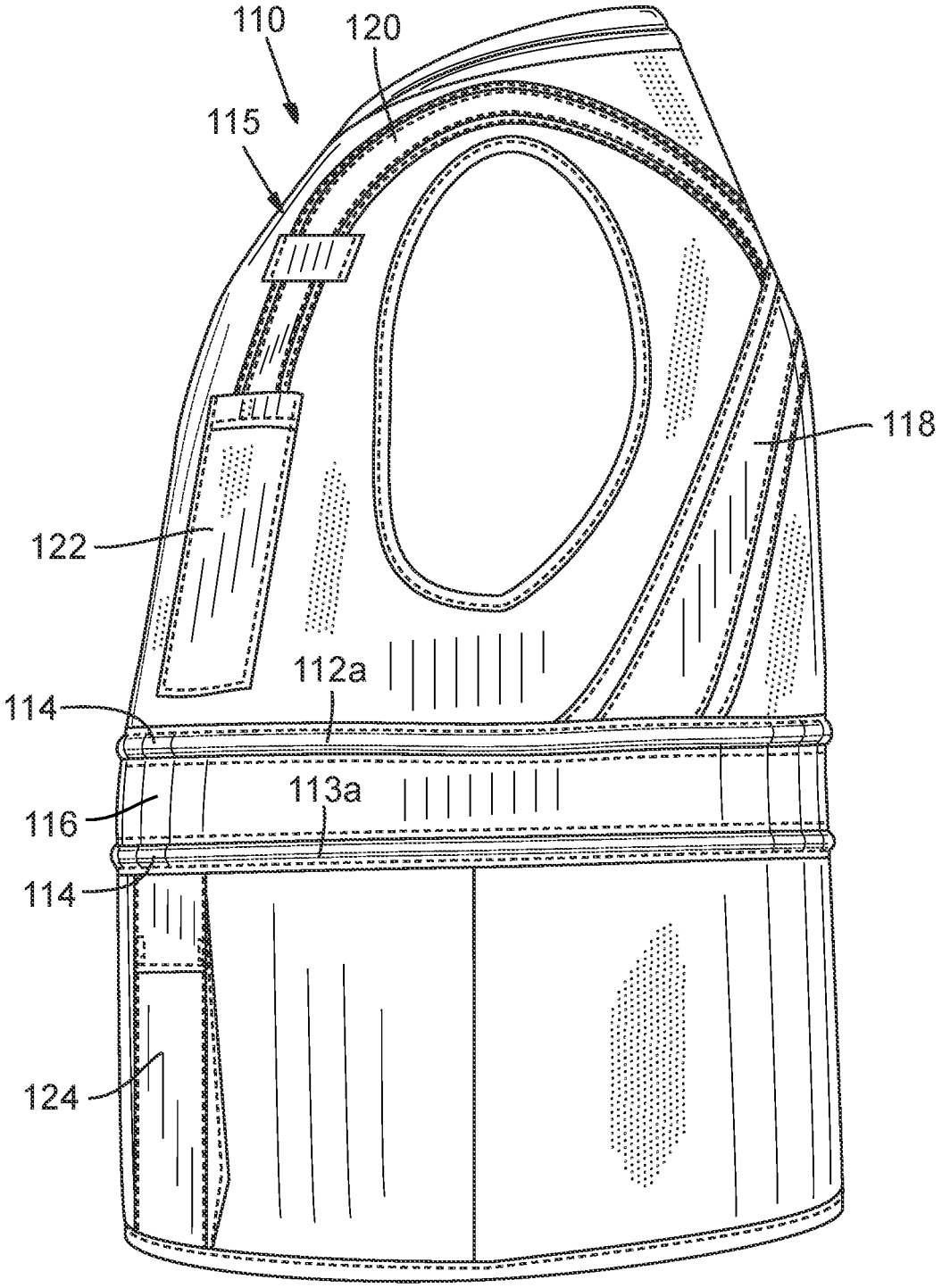
FIG. 19 is a side elevation view of the second embodiment from the left side.
Figure 20:
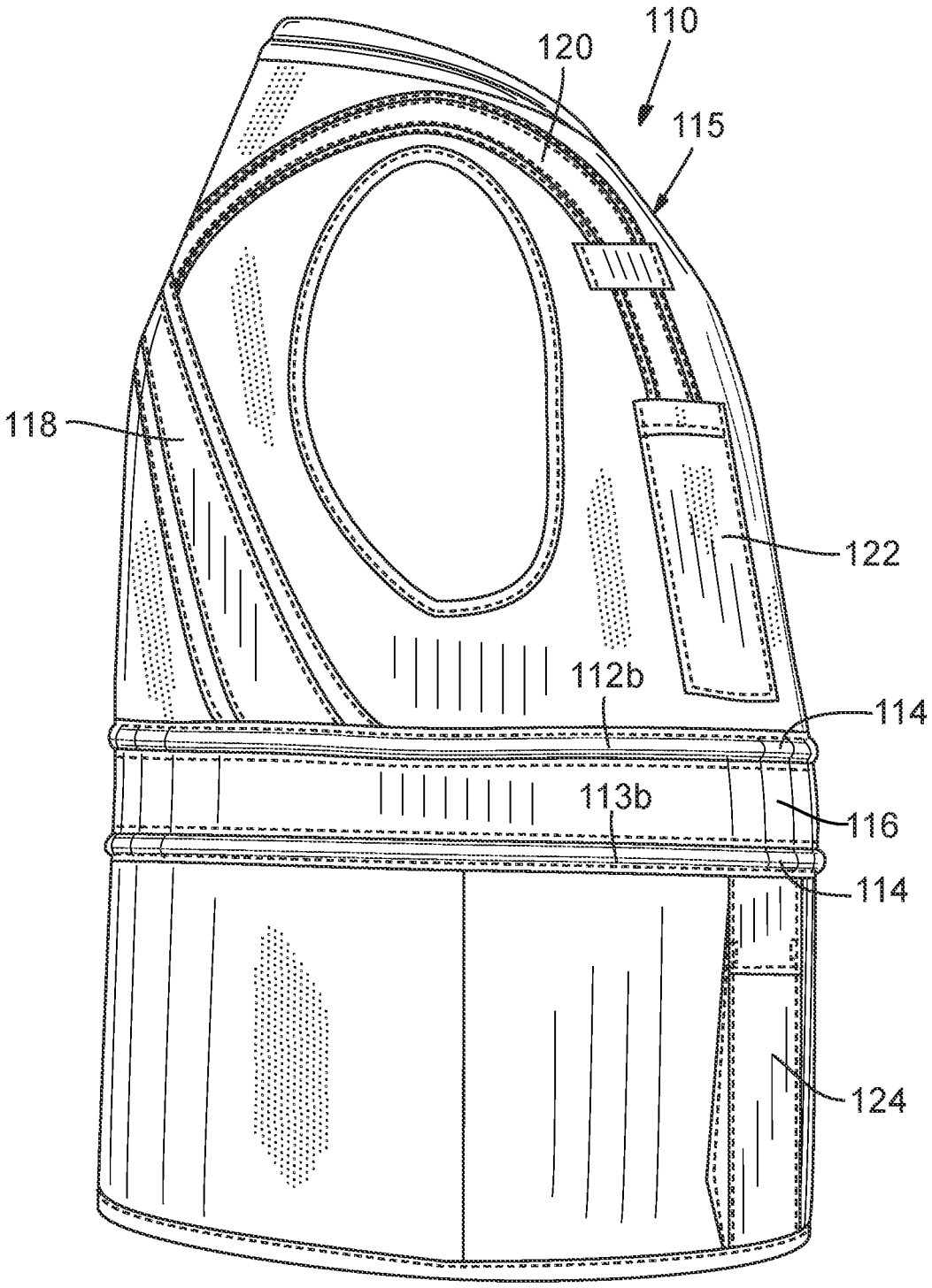
FIG. 20 is a side elevation view of the second embodiment from the right side.
Figure 21:
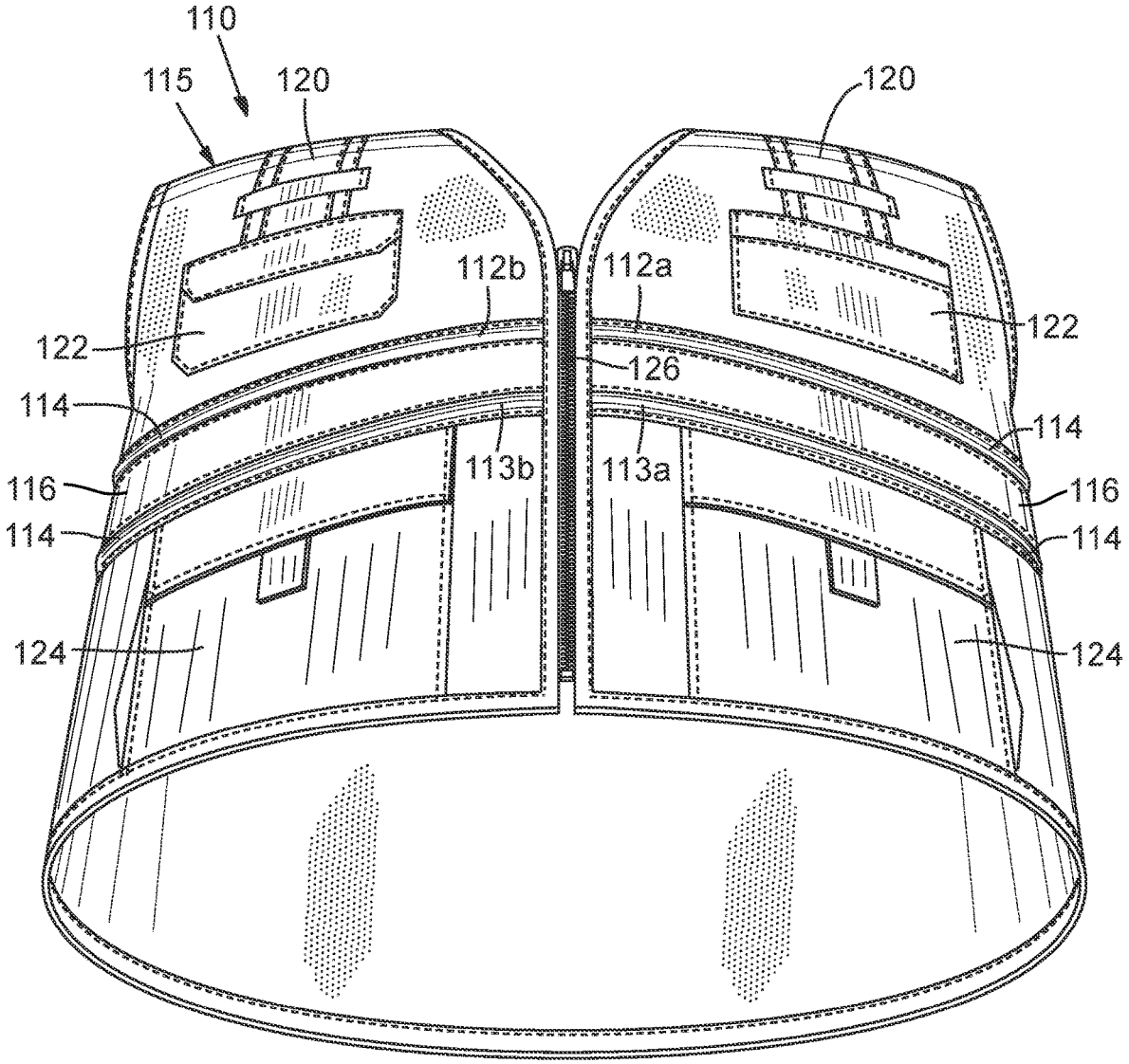
FIG. 21 is a perspective view of the second embodiment from a lower front angle.
Figure 22:
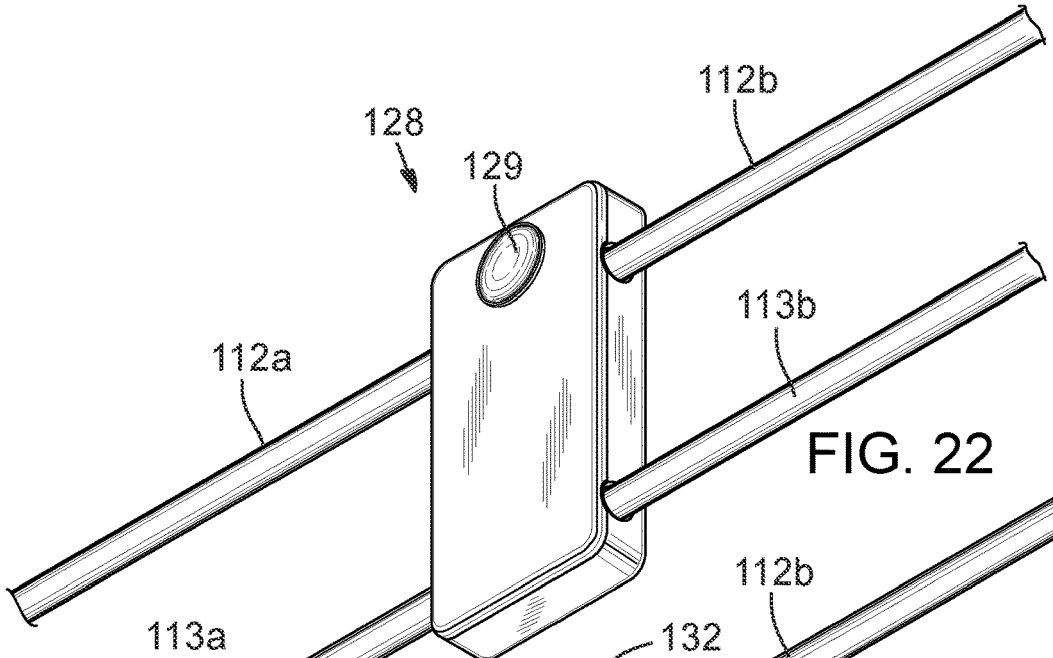
FIG. 22 is a perspective view of the light source of the second embodiment from a lower, front angle showing the first and second pair of tubes extending therefrom.
Figure 23:
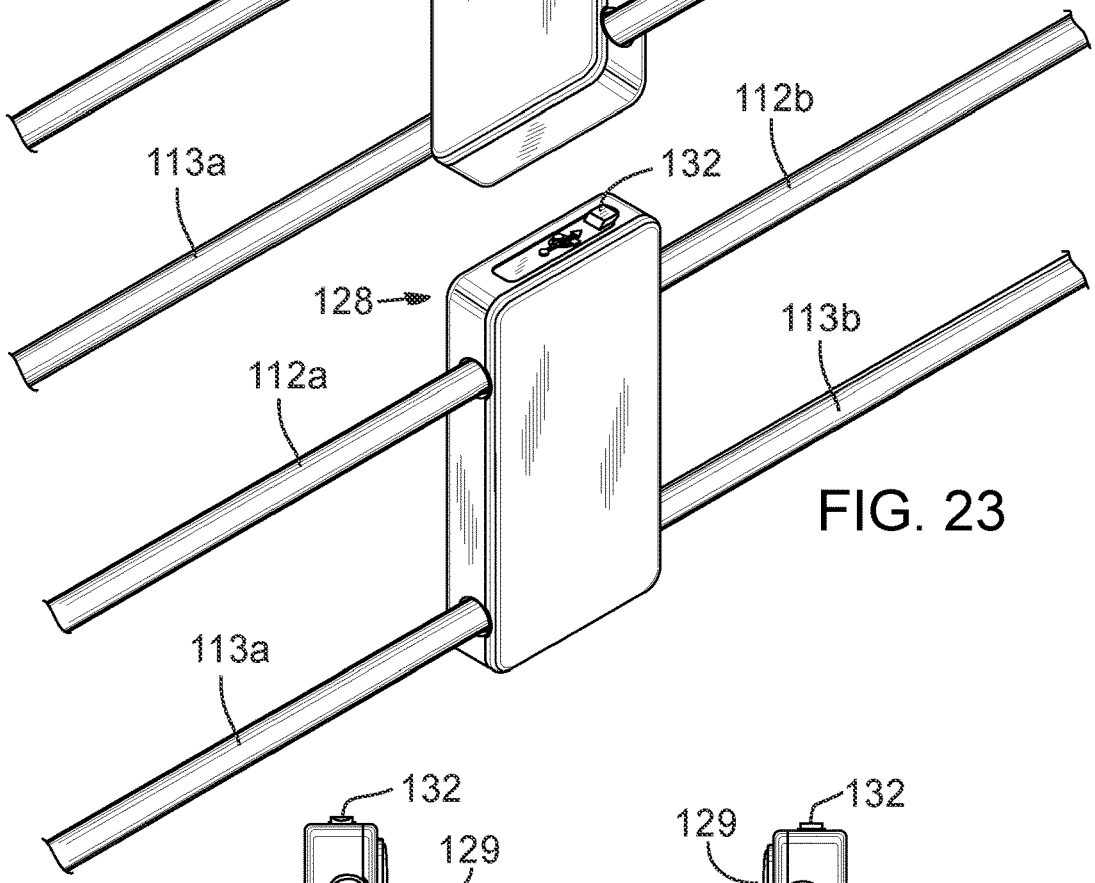
FIG. 23 is a perspective view of the light source and tubes of the second embodiment from an upper, rear angle.
Figure 24:
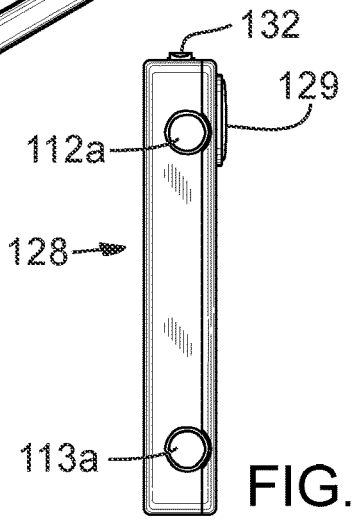
FIG. 24 is a side elevation view of the light source and tubes of the second embodiment taken from the right side.
Figure 25:
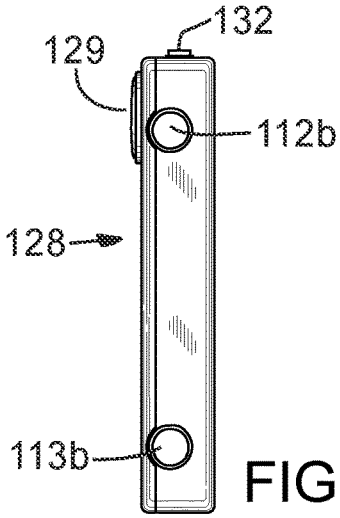
FIG. 25 is a side elevation view of the light source and tubes of the second embodiment taken from the left side.
Figure 26:
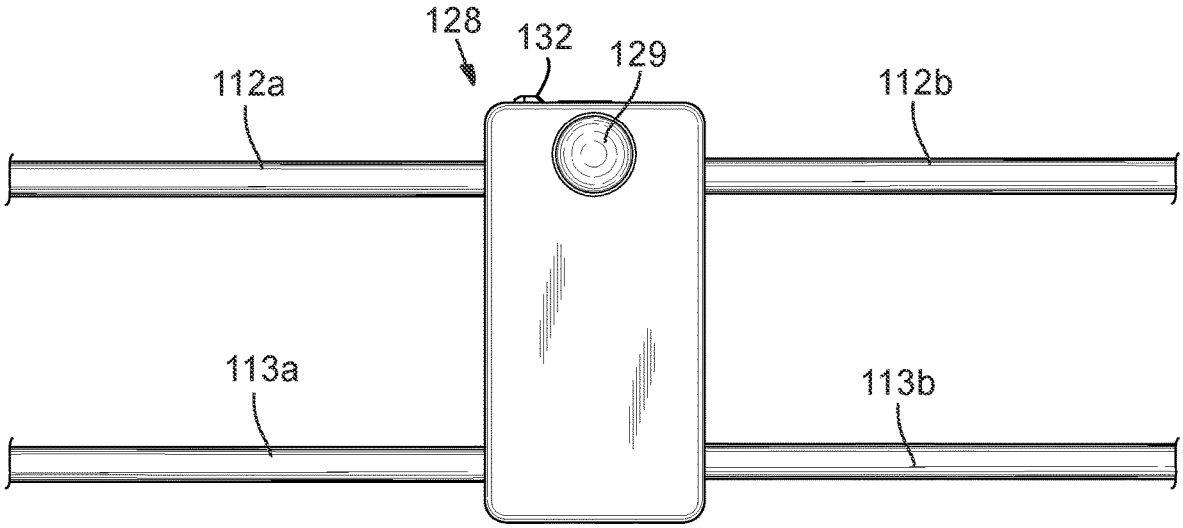
FIG. 26 is a front elevation view of the light source and tubes of the second embodiment.

In the following detailed description, reference is made to the accompanying drawings which form a part hereof, and in which are shown by way of illustration embodiments that may be practiced. It is to be understood that other embodiments may be utilized and structural or logical changes may be made without departing from the scope. Therefore, the following detailed description is not to be taken in a limiting sense, and the scope of embodiments is defined by the appended claims and their equivalents.

Various operations may be described as multiple discrete operations in turn, in a manner that may be helpful in understanding embodiments; however, the order of description should not be construed to imply that these operations are order dependent.

The description may use perspective-based descriptions such as up/down, back/front, and top/bottom. Such descriptions are merely used to facilitate the discussion and are not intended to restrict the application of disclosed embodiments.

The terms "coupled" and "connected," along with their derivatives, may be used. It should be understood that these terms are not intended as synonyms for each other. Rather, in particular embodiments, "connected" may be used to indicate that two or more elements are in direct physical or electrical contact with each other. "Coupled" may mean that two or more elements are in direct physical or electrical contact. However, "coupled" may also mean that two or more elements are not in direct contact with each other, but yet still cooperate or interact with each other.

For the purposes of the description, a phrase in the form "A/B" or in the form "A and/or B" means (A), (B), or (A and B). For the purposes of the description, a phrase in the form "at least one of A, B, and C" means (A), (B), (C), (A and B), (A and C), (B and C), or (A, B and C). For the purposes of the description, a phrase in the form "(A)B" means (B) or (AB) that is, A is an optional element.

The description may use the terms "embodiment" or "embodiments," which may each refer to one or more of the same or different embodiments. Furthermore, the terms "comprising," "including," "having," and the like, as used with respect to embodiments, are synonymous, and are generally intended as "open" terms (e.g., the term "including" should be interpreted as "including but not limited to," the term "having" should be interpreted as "having at least," the term "includes" should be interpreted as "includes but is not limited to," etc.).

With respect to the use of any plural and/or singular terms herein, those having skill in the art can translate from the plural to the singular and/or from the singular to the plural as is appropriate to the context and/or application. The various singular/plural permutations may be expressly set forth herein for sake of clarity.

One aspect of the invention provides a safety vest having a vest body including front, back and sides, a light source, including a battery pack and at least one LED, the light source being removably mounted to the vest body, at least one light tube extending from one side of the light source, for receiving light projected from the LED and conveying the light along the length of the light tube, the light tube extending along the front, back or sides of the vest, and vest fabric mounted over the light tube to hold it in position against the vest body, the vest fabric being at least translucent and therefore permitting light from the light tube to shine therethrough.

The safety vest may further comprise a second light tube extending from an opposite side of the light source, forming a first pair of light tubes that extend from the light source in opposite directions generally around the waist region of the vest, the second light tube also being held in position against the vest by the vest fabric but permitting light from the second light tube to shine therethrough.

The safety vest may include a reflective portion extending adjacent to the light tube for at least a majority of the length of the light tube, and/or the light source may be removably mounted to an inner side of the vest body by a mounting fabric attached to the inner side of the vest such that a cavity is formed between the mounting fabric and the inner side of the vest for receiving the power source therein.

A second pair of light tubes may be included, the tubes of the second pair of light tubes extending in opposite directions from the light source generally around the waist region of the vest, the second pair of light tubes being held in position against the vest by the vest fabric but permitting light from the second pair of light tubes to shine therethrough. A reflective portion may be disposed between the first and second pair of light tubes for at least a majority of the length of the first and second pair of light tubes.

The light source may be removably mounted to an inner side of the vest body by a mounting fabric attached to the inner side of the vest such that a cavity is formed between the mounting fabric and the inner side of the vest for receiving the power source therein.

Another aspect of the invention is a safety vest including a vest body including front, back and sides, a light source having a battery pack and at least one LED, a pair of light tubes that extend in opposite directions from the light source around a waist region of the vest for receiving light projected from the LED and conveying the light along its length, and a reflective portion extending adjacent to the pair of light tubes for reflecting light shining from the light tubes.

The light source may be removably mounted to an inner side of the vest by a mounting fabric attached to the inner side of the vest such that a cavity is formed between the mounting fabric and the inner side of the vest for receiving the power source therein. The vest may also include vest fabric mounted over the pair of light tubes to hold them in position against the vest, the fabric being of a bright translucent color so that light from the light tubes shining through the vest fabric is of the bright color.

The vest may also include a second pair of light tubes extending in opposite directions from the light source parallel to the first pair of light tubes. A reflective sash may extend between the first and the second pair of light tubes, and the light source may be removably mounted to an inner side of the vest by a mounting fabric attached to the inner side of the vest such that a cavity is formed between the mounting fabric and the inner side of the vest for receiving the power source therein. Vest fabric may be mounted over the first and second pair of light tubes to hold them in position against the vest, the fabric being of a bright translucent color so that light from the light tubes shining through the vest fabric is of the bright color.

FIGS. 1-14 best depict a first embodiment of a lighted safety vest, identified generally with the numeral 10. Vest 10 is largely conventional, with a vest body shaped to the body of the typical wearer, including a front, back and sides. Vest 10 is different from conventional vests in that it includes a pair of light tubes 12A and 12B that project light to protect the wearer when in darkened settings. Light tubes 12A and 12B typically but not necessary extend around vest 10 generally in the waist region and are held in place by what is typically a brightly colored layer of translucent fabric layer 14. Thus, while light tubes 12A and 12B may emit clear or white light, fabric layer 14 may cause the light to be a bright color such as orange, yellow or red. Fabric layer 14 may alternatively be transparent, so it may be described herein as "at least translucent," meaning it is translucent or transparent.

As in conventional safety vests, vest 10 may include a reflective lateral sash 16. However, in the depicted embodiment lateral sash 16 may be disposed immediately adjacent light tube 12 as shown in FIGS. 1-7 in order to reflect light emanating from the light tubes. Lateral sash 16 typically extends for a majority of the length of the light tubes if not the entire length. Reflective cross sashes 18 may extend across the back of vest 10, and reflective vertical sashes 20 may extend down the front of the vest. As in conventional vests, vest 10 may also include a series of pockets such as those shown at 22 and 24 in the front of the vest. A zipper 26 typically is also disposed in the front of vest 10 to permit the user to easily remove the vest.

Power for light tubes 12A and 12B is provided by a light source, indicated generally at 28 in FIGS. 1, 3, 6 and 8-14. The depicted position of light source 28 is in the center of the back of the wearer, as shown in phantom in FIGS. 1, 3 and 6, although it may be positioned elsewhere. It is also possible to include multiple light sources. Light source 28 is shown in phantom in these views because it is typically disposed under a layer of vest fabric 30, with light tube 12A extending in one direction and light tube 12B extending in the other direction. However, it should be understood that a single light tube may instead be provided to extend from one side of the light source. Light source 28 includes an on/off button 29, which is operated through vest fabric 30 so the light source does not need to be removed in order to be turned on and off.

As shown best in FIGS. 8-14, light source 28 is sized to incorporate batteries. It is often preferable that the batteries be rechargeable, so light source 28 includes a USB recharging port 32 at its base. The batteries provide power to a pair of LEDs 34, shown schematically in FIG. 12, that provide bright light to each of light tubes 12A and 12B. In this manner, bright light is provided through each of the light tubes to provide a bright warning light that typically is orange, yellow or red due to the color of translucent fabric layer 14. That light is typically far brighter than what would be provided with a conventional reflective vest or one with simply a series of LED buttons such as found in the prior art.

Light source 28 is typically disposed under a layer of vest fabric 30, with mountings that may use snaps, Velcro or some other removable mounting system to removably mount light source 28 to vest 10. This will permit light source 28 to be removed for re-charging the batteries. This removable mounting system will be described in detail in connection with the second embodiment 110 to be described now. That system is depicted in FIGS. 30 and 31.

A second embodiment 110 having a second pair of tubes is depicted in FIGS. 15-21. This second embodiment 110 may be similar to embodiment 10 in all respects other than that it includes a second, lower pair of light tubes 113A and 113B. Because the features of the second embodiment 110 are so similar to vest 10, similar designation numbers will be used except in the 100 series. Thus, vest 110 typically includes a first pair of upper light tubes 112A and 112B, with translucent fabric layer 114 covering all four of the light tubes, the fabric typically being of a bright color such as orange, yellow or red. A reflective lateral sash 116 is normally disposed between the upper and lower light tubes 112A and 112B and 113A and 113B so that light from the light tubes shines brightly on the reflective lateral sash. Reflective cross sashes 118 may also be provided, along with pockets 122 and 124 and a zipper 126.

Figure 27:
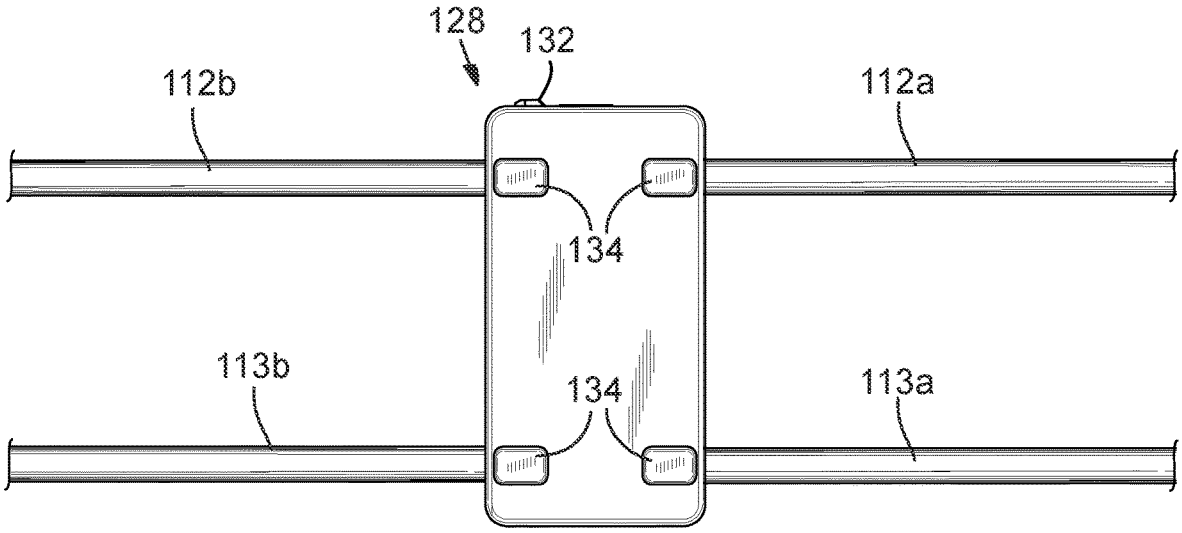
FIG. 27 is a rear elevation view of the light source and tubes of the second embodiment.
Figure 28:
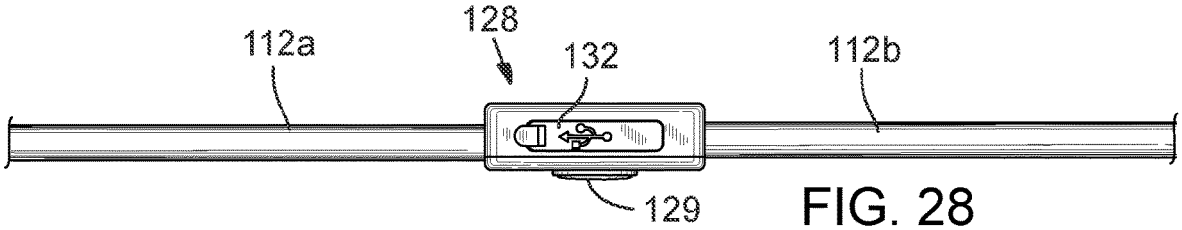
FIG. 28 is a top plan view of the light source and tubes of the second embodiment.
Figure 29:
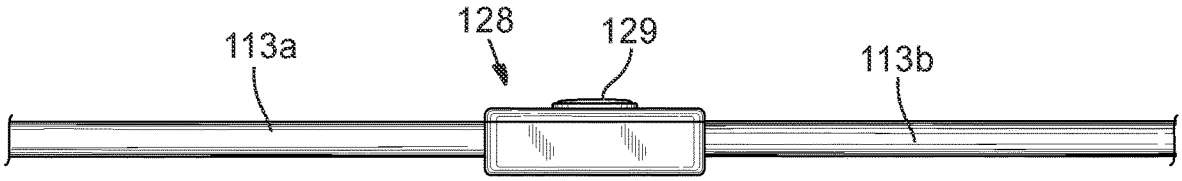
FIG. 29 is a bottom view of the light source and tubes of the second embodiment.

Light source 128 is typically covered with fabric 130 and includes a recharging port 132. In the depicted second embodiment the recharging port is dispose at the top of the light source instead of at the bottom as depicted in light source 28. Instead of two LEDs, light source 128 typically includes four LEDs 134, two on the top for upper light tubes 112A and B and two for on the bottom for lower light tubes 113A and B. FIG. 27 includes a schematic depiction of the four LEDs 134.

Figure 30:
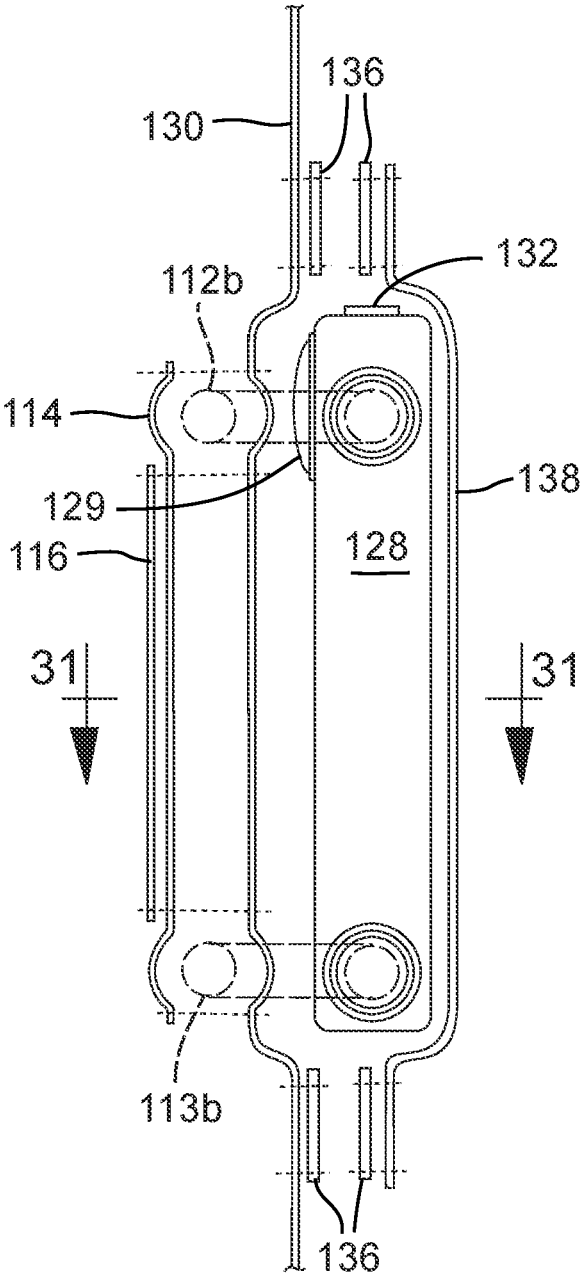
FIG. 30 is a schematic sectional, partially exploded view taken along line 30-30 of FIG. 15.
Figure 31:
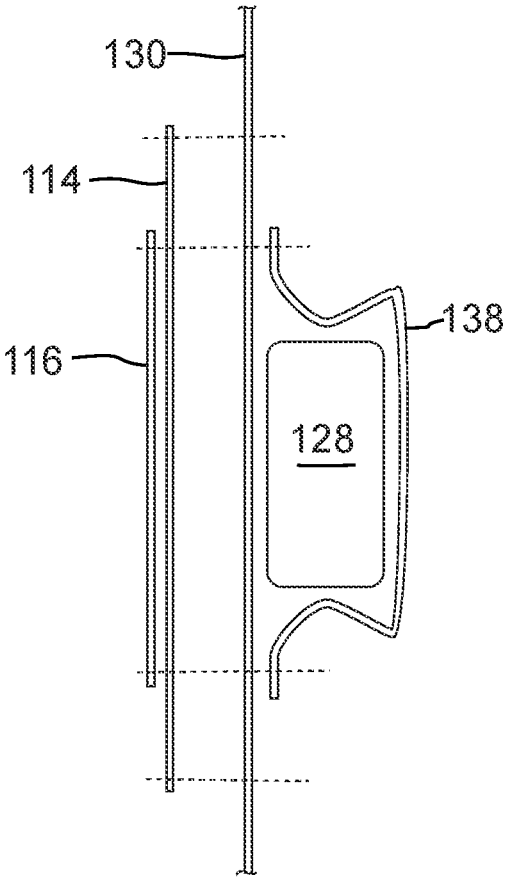
FIG. 31 is a schematic sectional view taken along line 31-31 of FIG. 30.

FIGS. 30 and 31 schematically show a typical removable mounting system for either light source 28 or 128. It shows the light source being mounted by Velcro tabs 136 to the inner side of vest fabric 130 of vest 110. An inner layer of fabric 138 removably holds light source 128 against the inner side of vest fabric 130. Reflective lateral sash 116 is shown on the outer side of vest fabric 130, and translucent fabric layer 114 is shown extending over light tubes 112*b* and 113*b*. In order to best show this arrangement, FIG. 30 is shown to be somewhat exploded.

Although certain embodiments have been illustrated and described herein, it will be appreciated by those of ordinary skill in the art that a wide variety of alternate and/or equivalent embodiments or implementations calculated to achieve the same purposes may be substituted for the embodiments shown and described without departing from the scope. Those with skill in the art will readily appreciate that embodiments may be implemented in a very wide variety of ways. This application is intended to cover any adaptations or variations of the embodiments discussed herein. Therefore, it is manifestly intended that embodiments be limited only by the claims and the equivalents thereof.

The invention claimed is:

1. A safety vest comprising:

a vest body including a front, a back and sides;

a light source, including a battery pack and at least one LED, the light source being removably mounted to the vest body, wherein the light source is removably mounted to an inner side of the vest by a mounting fabric attached to the inner side of the vest such that a cavity is formed between the mounting fabric and the inner side of the vest for receiving the battery pack therein;

a first pair of light tubes extending from opposite sides of the light source, for receiving light projected from the LED and conveying the light along a length of the respective light tubes, the first pair of light tubes extending along the front, back or sides of the vest;

a second pair of light tubes, the light tubes of the second pair of light tubes extending in opposite directions from the light source generally around a torso region of the vest, the second pair of light tubes being held in position against the vest by the vest fabric but permitting light from the second pair of light tubes to shine therethrough; and a vest fabric mounted over at least one of the light tubes of the first or second pairs of light tubes to hold it in position against the vest body, the vest fabric being at least translucent and therefore permitting light from the respective light tube to shine therethrough.

2. The safety vest of claim 1, further comprising a reflective portion extending adjacent to the light tube for at least a majority of the length of the light tube.

3. The safety vest of claim 1, wherein the light source is removably mounted to an inner side of the vest by a mounting fabric attached to the inner side of the vest such that a cavity is formed between the mounting fabric and the inner side of the vest for receiving the light source therein.

4. The safety vest of claim 1, further comprising a reflective portion disposed between the first and second pair of light tubes for at least a majority of the length of the first light tube and a length of the second light tube.

5. A safety vest comprising:

a vest body including a front, a back and sides;

a light source, including a battery pack and at least one LED, wherein the light source is removably mounted to an inner side of the vest body by a mounting fabric attached to the inner side of the vest such that a cavity is formed between the mounting fabric and the inner side of the vest for receiving the light source therein;

a pair of light tubes that extend in opposite directions from the light source around a torso region of the vest for receiving light projected from the LED and conveying the light along a length of the light tubes; and a reflective portion extending adjacent to the first pair of light tubes for reflecting light shining from the light tubes.

6. The safety vest of claim 5, wherein a vest fabric is mounted over the pair of light tubes to hold them in position against the vest, the vest fabric being of a bright translucent color so that light from the light tubes shining through the vest fabric is of the bright color.

7. The safety vest of claim 5, wherein the pair of light tubes is a first pair of light tubes, and wherein the safety vest further comprises a second pair of light tubes extending in opposite directions from the light source parallel to the first pair of light tubes.

8. The safety vest of claim 7, wherein a reflective sash extends between the first and the second pair of light tubes.

9. The safety vest of claim 7, wherein a vest fabric is mounted over the first and second pair of light tubes to hold them in position against the vest, the vest fabric being of a bright translucent color so that light from the light tubes shining through the vest fabric is of the bright color.

10. A safety vest comprising:

a vest body including a front, a back and sides;

a light source, including a battery pack and at least one LED, the light source being removably mounted to the vest body; and at least one light tube extending from one side of the light source, for receiving light projected from the LED and conveying the light along a length of the light tube, the light tube extending along the front, back or sides of the vest, wherein the light source is removably mounted to an inner side of the vest by a mounting fabric attached to the inner side of the vest such that a cavity is formed between the mounting fabric and the inner side of the vest for receiving the light source therein.

11. The safety vest of claim 10, further comprising vest fabric mounted over the light tube to hold it in position against the vest body, the vest fabric permitting light from the light tube to shine therethrough.

12. The safety vest of claim 11, further comprising a second light tube extending from an opposite side of the light source, forming a first pair of light tubes that extend from the light source in opposite directions generally around the torso region of the vest, the second light tube also being held in position against the vest by the vest fabric but permitting light from the second light tube to shine therethrough.

13. The safety vest of claim 10, further comprising a second pair of light tubes, the tubes of the second pair of light tubes extending in opposite directions from the light source generally around the torso region of the vest.

14. A safety vest comprising:

a vest body including a front, a back and sides;

a light source, including a battery pack and at least one LED, wherein the light source is removably mounted to an inner side of the vest body by a mounting fabric attached to the inner side of the vest such that a cavity is formed between the mounting fabric and the inner side of the vest for receiving the light source therein;

a first pair of light tubes that extend in opposite directions from the light source around a region of the vest for receiving light projected from the LED and conveying the light along a length of the first pair of light tubes; and a second pair of light tubes extending in opposite directions from the light source parallel to the first pair of light tubes.

15. The safety vest of claim 14, further comprising a reflective portion disposed between the first and second pair of light tubes for at least a majority of the length of the first pair of light tubes.

16. The safety vest of claim 15, further comprising vest fabric mounted over at least one of the first or second pair of light tubes to hold the respective light tubes in position against the vest body, the vest fabric permitting light from the light tube to shine therethrough.

17. The safety vest of claim 14, wherein a reflective sash extends between the first and the second pair of light tubes.

* * * * *